US011142361B2

(12) United States Patent
Plate

(10) Patent No.: US 11,142,361 B2
(45) Date of Patent: Oct. 12, 2021

(54) METHOD AND APPARATUS FOR MANUFACTURING A DOUBLE BAG

(71) Applicant: Plümat Plate & Lübeck GmbH & Co., Espelkamp (DE)

(72) Inventor: Sven-David Plate, Espelkamp-Frotheim (DE)

(73) Assignee: Plümat Plate & Lübeck GmbH & Co., Espelkamp (DE)

( * ) Notice: Subject to any disclaimer, the term of this patent is extended or adjusted under 35 U.S.C. 154(b) by 78 days.

(21) Appl. No.: 16/396,131

(22) Filed: Apr. 26, 2019

(65) Prior Publication Data

US 2019/0248525 A1 Aug. 15, 2019

Related U.S. Application Data

(63) Continuation-in-part of application No. PCT/EP2018/000102, filed on Mar. 20, 2018.

(30) Foreign Application Priority Data

Mar. 20, 2017 (GB) ..... 1704407

(51) Int. Cl.

| | |
|---|---|
| ***B65B 31/04*** | (2006.01) |
| ***B65B 51/14*** | (2006.01) |
| ***B65D 77/04*** | (2006.01) |
| ***B65D 81/20*** | (2006.01) |
| *B65B 3/00* | (2006.01) |
| *A61J 1/10* | (2006.01) |

(52) U.S. Cl.

CPC ..... *B65B 31/042* (2013.01); *B65B 31/048* (2013.01); *B65B 51/146* (2013.01); *B65D 77/04* (2013.01); *B65D 81/20* (2013.01); *A61J 1/10* (2013.01); *B65B 3/003* (2013.01); *B65B 2220/20* (2013.01)

(58) Field of Classification Search

CPC ..... B65D 77/04; B65D 81/20; B65D 33/16; B65B 2220/20; B65B 31/048; B65B 3/003

See application file for complete search history.

(56) References Cited

U.S. PATENT DOCUMENTS

| | | | |
|---|---|---|---|
| 2,362,799 | A | 11/1944 | Boyd et al. |
| 3,789,888 | A | 2/1974 | James et al. |
| 3,942,301 | A | 3/1976 | Domke |

(Continued)

FOREIGN PATENT DOCUMENTS

| | | | |
|---|---|---|---|
| CN | 104583081 | A1 | 4/2015 |
| EP | 1754671 | A1 | 2/2007 |

(Continued)

*Primary Examiner* — Andrew M Tecco
*Assistant Examiner* — Nicholas E Igbokwe
(74) *Attorney, Agent, or Firm* — 24IP Law Group USA, PLLC; Timothy R DeWitt

(57) ABSTRACT

A method and apparatus for manufacturing a double bag (20) are disclosed. The method comprises placing an inner bag (30) in an outer bag (40) through an open top end (42), inserting a gas feeding tube (50) between through the open top end (42), feeding a head space (44) between the inner bag (30) and the outer bag (40) with an inert gas through the gas feeding tube (50), extracting the gas feeding tube (50), and sealing the top end (42). A gas box (80) surrounds the open top end (42) to reduce the risk of oxygen entering the head space (44).

15 Claims, 4 Drawing Sheets

(56) References Cited

U.S. PATENT DOCUMENTS

| | | | | |
|---|---|---|---|---|
| 5,201,165 | A * | 4/1993 | Marano | B65B 31/041 53/432 |
| 5,291,165 | A | 3/1994 | Whipple et al. | |
| 5,501,525 | A * | 3/1996 | Cox | B65D 81/2084 383/103 |
| 5,667,827 | A | 9/1997 | Breen et al. | |
| 2004/0201654 | A1* | 10/2004 | Morita | B41J 2/17513 347/86 |
| 2005/0263209 | A1* | 12/2005 | Dietrich | B08B 15/026 141/114 |
| 2012/0269459 | A1* | 10/2012 | Howes | B65D 81/07 383/37 |

FOREIGN PATENT DOCUMENTS

| | | | |
|---|---|---|---|
| EP | 2022720 | A2 | 2/2009 |
| EP | 2308757 | A1 | 4/2011 |
| EP | 2889227 | A1 | 7/2015 |
| GB | 2475720 | A | 6/2011 |
| JP | 2015000745 | A | 1/2015 |
| WO | 03009709 | A1 | 2/2003 |

* cited by examiner

METHOD AND APPARATUS FOR MANUFACTURING A DOUBLE BAG

CROSS-REFERENCE TO RELATED APPLICATIONS

This application is a continuation-in-part of International Patent Application No. PCT/EP2018/000102 filed on 20 Mar. 2018 which application claims benefit to and the priority of Patent Application No. 1 704 407.4 filed in the United Kingdom on 20 Mar. 2017. The entire disclosures of UK Patent Application No. 1 704 407.4 and the international patent application No. PCT/EP2018/000102 are incorporated herein by reference.

BACKGROUND OF THE INVENTION

Field of the Invention

The invention relates to a method and apparatus for manufacturing a double bag, for example an outer bag with one or more inner bags. In one aspect of the invention, the inner bag may comprise pharmaceutical or biological materials.

Background of the Invention

This document describes a method and apparatus for manufacturing a double bag which comprises an inner bag and a surrounding outer bag (also called over pouch). A so-called "head space" between the inner bag and the outer bag is filled with an inert gas, such as nitrogen. There may be more than one inner bag inside of the outer bag and the inner bag may have one or more chambers.

Such double bags have been known for some time. They are used to store pharmaceutical, nutraceutical and other similar products. The outer bag protects the inner bag and ensures that the inner bag and its contents remain sterile. Atmospheric oxygen is removed as far as possible from the head space between the inner bag and the outer bag as this prolongs the life of the packaged materials by reducing substantially the risk of oxidation of the contents of the inner bag.

Several techniques for flushing bags with the inert gas are known. For example, U.S. Pat. No. 3,789,888 teaches a means for flushing a single bag with an inert gas by inserting a gas delivering tube into the bag.

Another technique is known from U.S. Pat. No. 5,667,827 which teaches a method for packaging fresh meat in a substantially oxygen-free atmosphere. In this case, the meat is initially placed in a packaging tray and overwrapped with a web of clear plastic material, which is ventilated to allow gas communication. A plurality of overwrapped packaging trays are then placed in an outer carrier bag which is first evacuated of normal atmosphere, including oxygen, and then flushed with a preservation-enhancing gas, such as nitrogen.

Another example of a bagging and packaging machine which includes a delivery apparatus for introducing inert gas into bags is known from European Patent Application No EP2 022 720 which teaches a gas supply means for supplying the inert gas into the bag to substitute for air contained in the bag. The bagging and packaging machine include an oxygen detecting means for detecting a quantity of oxygen remaining in the bag and a gas supply control means which controls the supply of inert gas to the machine and adjusts the supply of the inert gas into the bag dependent on the state of the remaining oxygen in the bag.

U.S. Pat. No. 5,291,165 (Marano, assigned to International Paper) teaches a so-called gas displacement device and method for substituting inert gas for ambient air in a gable-top paperboard carton prior to closing of an open top of the carton. The open top has first and second predetermined dimensions in mutually perpendicular directions. The device includes a source of inert gas, a channel for outputting a blanket of inert gas through an outlet and a conveyor for moving cartons in the first direction so that each open top passes under the outlet.

European Patent Application No. EP 2 308 757 (Südpack Verpackungen) teaches a method for producing bags that are to be filled with foodstuffs. The method involves producing a first bag from a first film web and filling the first bag with food, A second bag is also produced from a film web and the first bag is inserted into the second bag. The second bag is filled before closure with a protective gas for preserving the food.

For packaging pharmaceutical materials as well as for packaging of food, there is a need to ensure that contamination of the contents (pharmaceuticals or food) of the bags are avoided during the packaging process from the surrounding air and that the exposure to atmospheric oxygen is minimised. It is possible to package the products and create the double bags by manufacturing them in clean room conditions in a nitrogen atmosphere, as is known in the art. This requires a substantial amount of nitrogen as there will be a lot of waste as the finished double bags are removed from the filling and packaging machine.

SUMMARY OF THE INVENTION

A method for reducing the amount of nitrogen used and simplifying the manufacturing process for the double bags with an inner bag and an outer bag is described in this document. The method comprises placing a gas box over the open top end of the double bag, inserting a gas feeder between through the open top end, feeding a head space between the inner bag and the outer bag with an inert gas through the gas feed, extracting the gas feeder, and subsequently sealing the top end. A sealed double bag is thereby formed.

This method reduces the amount of inert gas required since only the head space between the inner bag and the outer bag needs to be filled with the nitrogen and the double bag is not completely placed in an inert gas atmosphere during the manufacturing process. The gas box about the open top end reduces the risk of oxygen entering the head space.

In one aspect of the invention, the inert gas is nitrogen. It will be appreciated, however, that the nitrogen can be replaced or mixed with other inert gases.

The air, including atmospheric oxygen, from the head space can be removed from the head space prior to feeding the head space with the inert gas. This reduces further the risk of atmospheric oxygen remaining in the head space after sealing the top end. In one aspect of the method, the head space can be initially flushed with the inert gas a first time, followed by evacuation of the head space and subsequently feeding the head space with an inert gas a second time. This process of flushing and evacuating can be repeated several times.

The top end can be at least partially sealed prior to feeding the head space with the inert gas. This reduces the risk of leakage of the inert gas from the head space after filing and thus reduces the amount of inert gas required.

The inner bag comprises a liquid and/or a powder as the contents. These contents could be a pharmaceutical product, a nutraceutical product, a biological product or a foodstuff, but the invention is not limited thereto. The inner bag could have more than one box.

An apparatus for the manufacture of a double bag is also disclosed. The apparatus comprises a support, such as a transport belt, for placing the double bag in a bag sealing machine. A gas box is adapted to enclose an open top end of the outer bag to reduce the risk of oxygen entering the head space. A welding device for sealing top edges of the outer bag is present together with a gas feeding device for filing a head space between the inner bag and the outer bag with an inert gas.

The gas feeding device comprises a removable tube adapted to be removed after filling the head space with the inert gas. A vacuum device is present which enables evacuation of the head space, prior to filling the head space with the inert gas.

BRIEF DESCRIPTION OF THE DRAWINGS

For a more complete understanding of the present invention and the advantages thereof, reference is now made to the following description and the accompanying drawings, in which.

DETAILED DESCRIPTION OF THE INVENTION

Figure 2:
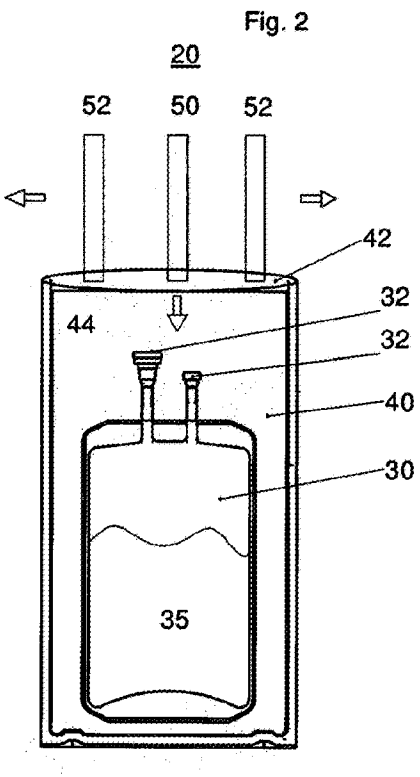
FIG. 2 shows a double bag.
Figure 1:
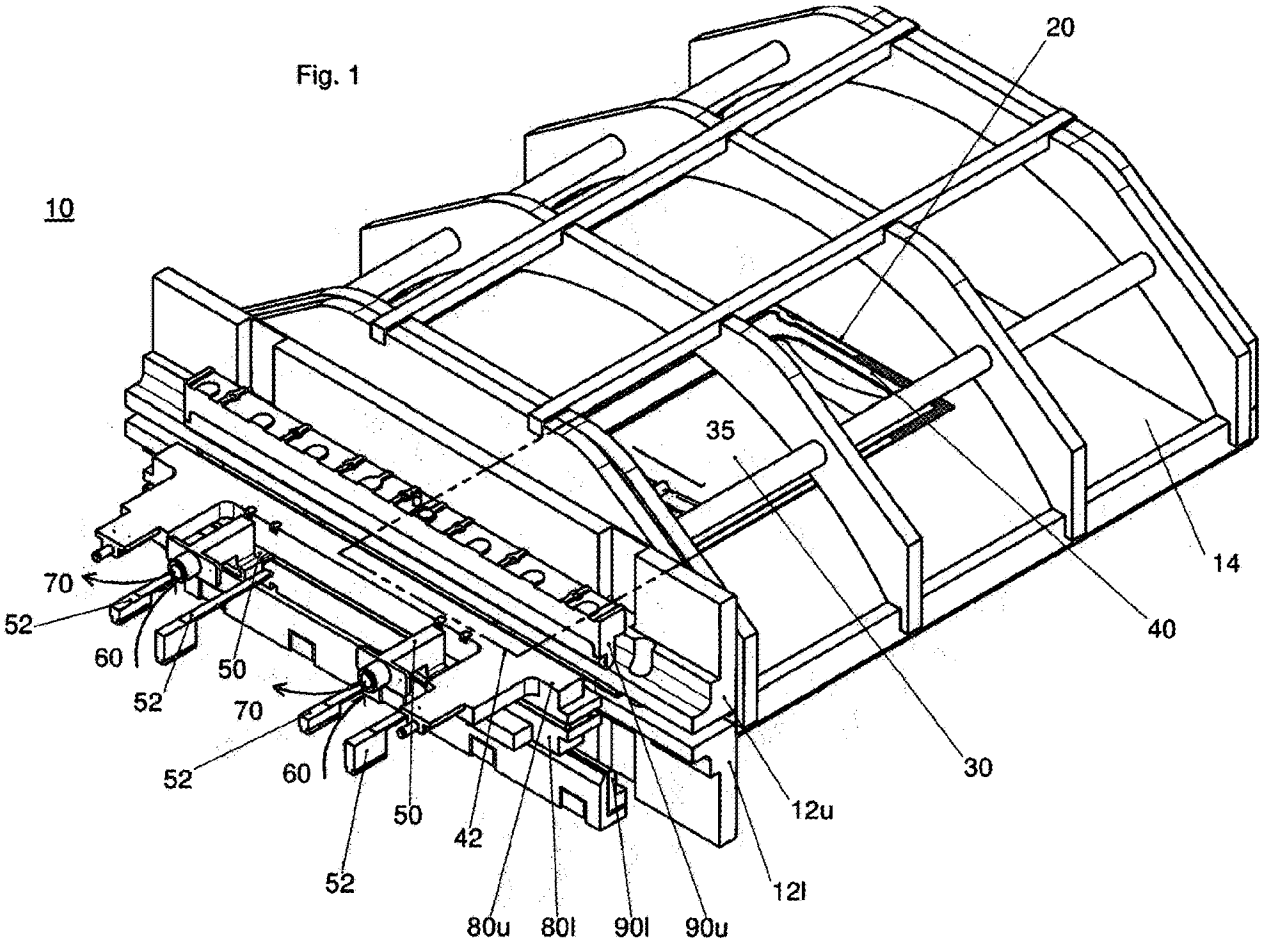
FIG. 1 shows an example of a manufacturing apparatus according to one aspect of this invention.

FIG. 1 shows a perspective view of an example of a manufacturing apparatus 10 for a double bag 20 according to one aspect of this invention and FIG. 2 shows an example of the double bag 20. The double bag 20 has an inner bag 30 and an outer bag 40. The inner bag 30 has at least one port 32, and commonly two ports, and is filled in one or more chambers with contents 35, e.g. a pharmaceutical product, such as but not limited to a saline solution, or a biological product, such as but not limited to blood products. The contents 35 can be in powder or fluid form and could also contain a mixture of powders and fluids. It would also be possible for the inner bag 30 to contain nutritional or nutraceutical products. The inner bag 30 is manufactured in another apparatus and the contents 35 remain sealed within the inner bag 30 during the manufacture of the double bag 20.

The outer bag 40 is placed about the inner bag 30 at a bag manufacturing position (not shown). The manufacturing apparatus 10 includes further an upper support 12*u* and a lower support 121 to hold the double bag 20 in position and a support 14 on which the double bag 20 is placed. In one aspect of the manufacturing apparatus, the support 14 is a transport belt on which the double bag 20 is placed and on which the double bag 20 is transported from the bag manufacturing position into the manufacturing apparatus 10. In another aspect, the support is a stationary support table 14 and the double bag 20 is placed onto the support table 14.

The double bag 20 is shown in more detail in FIG. 2. It will be appreciated that this double bag 20 is merely exemplary and its design is not limiting of the invention. The inner bag 30 and the outer bag 40 are manufactured from polymer materials, such as but not limited to polypropylene, that can be heat sealed. The polymer materials have barrier properties to reduce the risk of oxygen passing through the materials and contaminating the contents 35.

The manufacturing apparatus 10 is provided with a gas feeding tube 50 which can be inserted into an open top end 42 of the outer bag 40. The gas feeding tube 50 is connected to a gas supply 60 for supplying nitrogen gas (or another inert gas) into the outer bag 40. The gas feeding tube 50 can be inserted into and removed from the head space 44 between the inner bag 30 and the outer bag 40. The gas feeding tube 50 can also be connected to a vacuum pump 70 for removing gas from the head space 44. Alternatively, a separate tube could be connected to the vacuum pump 70. The manufacturing apparatus 10 includes two spreading arms 52 which can be used to open the top end 42 of the outer bag 40 to provide a smooth surface.

Figure 4A:
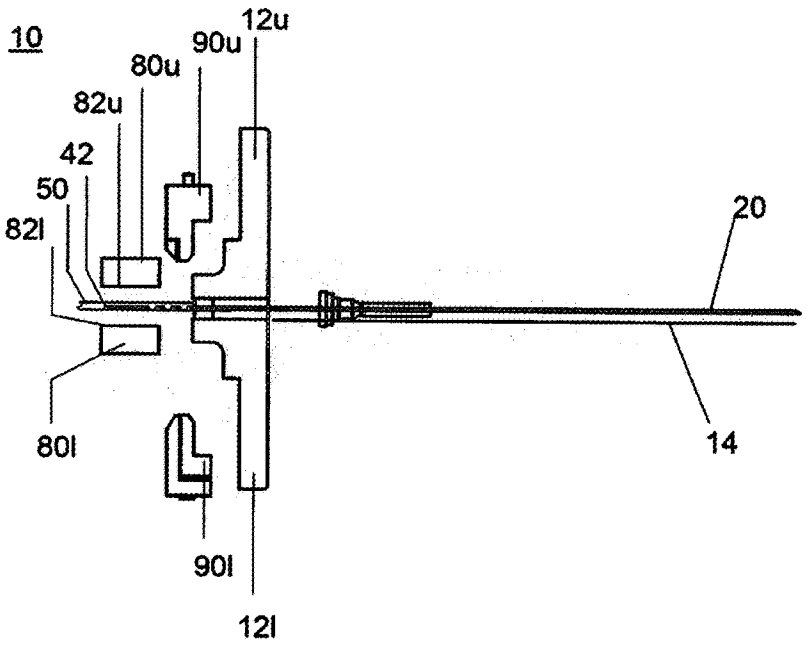
FIGS. 4A-4C show various stages of the method of manufacture.
Figure 4B:
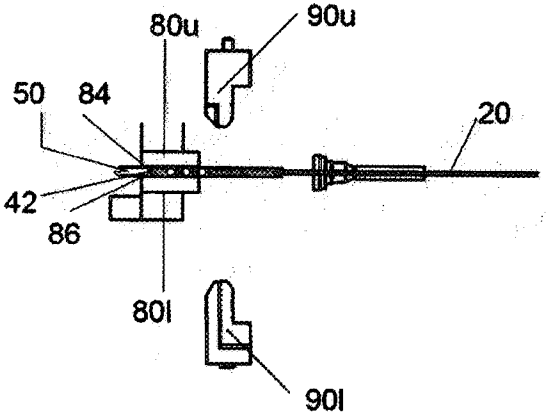
Figure 4C:
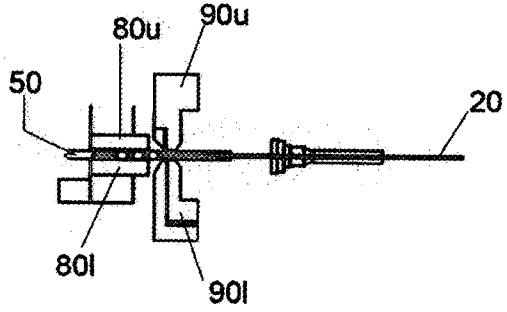

The manufacturing apparatus 10 includes a gas box 80 which is constructed from an upper box 80*u* and a lower box 801. The upper box 80*u* and the lower box 801 can be moved together to form the gas box 80 such that the gas box 80 encloses the top end 42 of the outer bag 40, as is shown in FIGS. 4B and 4C. The manufacturing apparatus has also a heating element 90 formed of an upper heating element 90*u* and a lower heating element 901. The gas box 80 and the heating element 90 are shown in more detail in FIGS. 4A-4C. It will be seen from FIG. 4A that the top end 42 of the outer bag 40 has been inserted between the upper box 80*u* and the lower box 801.

The top box 80*u* and the lower box 801 have each a sealing rim 82*u* and 821 which cooperate when the upper box 80*u* is closed onto the lower box 801 to form a nitrogen space 84 connected to a nitrogen feed line 86, as is shown in FIG. 4B. FIGS. 4A and 4B demonstrate that the open top end 42 is arranged, on closure of the upper box 80*u* and the lower box 801, such that the open top end 42 is located within the nitrogen space 84. The nitrogen space 84 is flushed with nitrogen gas through the nitrogen feed line 86.

The upper heating element 90*u* and the lower heating element 901 can also be moved together to form a weld or seam in the outer bag 40, as can be seen in FIG. 4C.

Figure 3:
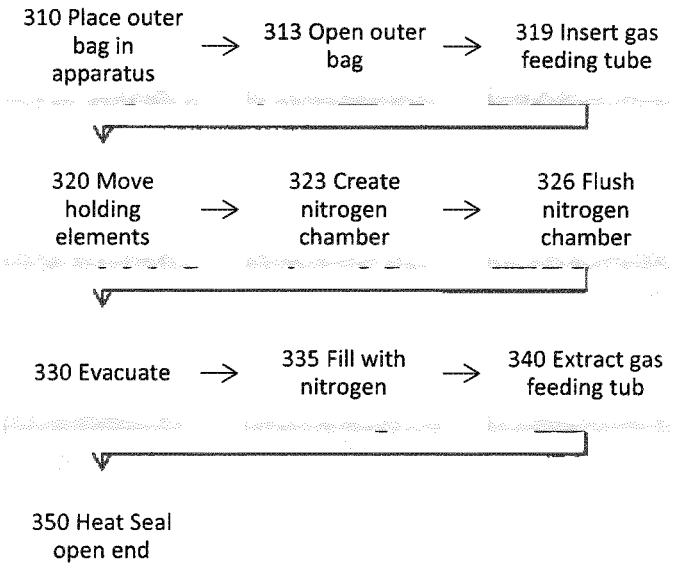
FIG. 3 illustrates the method of manufacture of the double bag.

FIG. 3 shows a flow diagram for the manufacture of the double bag 20. In a first step 310 the double bag 20 with the inner bag 30 and the outer bag 40 is transported into the manufacturing machine 10. This is done by placing the double bag 20 on the support 14 in the form of the transport belt. The outer bag 40 is opened in step 313. The opening 313 is carried out by pulling apart the two sheets forming the outer bag 40, for example using suckers and then inserting the spreading arms 52 into the open top end 42 of the outer bag 40 to spread open the open top end 42 of the bag and smooths the open top end 42. The gas feeding tube 50 is then inserted through the open top end 42 in step 319.

In step 320 the upper holding element 12*u* and the lower holding element 121 are moved together to hold the double bag 20 in the manufacturing apparatus, as is seen in FIG. 4A. In step 323 the upper box 80*a* and the lower box 80*b* are moved together to form the gas box 80 about the open top end 42. The gas box 80 is flushed with an inert gas—such as nitrogen—in step 326. In step 330 the head space 44 in the outer bag 40 can be evacuated and then filled in step 335 with an inert gas, such as nitrogen.

After filling the head space 44 in step 335, the gas feeding tube 50 is extracted in step 340 and the top end 42 heat sealed in step 350. The sealed double bag 20 with the inner bag 30 and the outer bag 40 can be transported out of the manufacturing apparatus 10 on the support 14 in the form of the transport belt.

The evacuation of the head space 44 in step 330 is optional. This evacuation removes as much air as possible before the head space 44 is filled with nitrogen. This minimises the amount of oxygen in the head space 44 before the outer bag 40 is sealed in step 350.

In a further aspect of the invention, the head space 44 can be evacuated again after a first filling with nitrogen in step 335 and then refilled with nitrogen. The first filling with nitrogen effectively flushes out any remaining oxygen in the bag before the second filling with nitrogen. The flushing and refilling process can be repeated several times to remove any remaining residual oxygen.

The gas box 80 encloses the top end 42 of the outer bag 40 in order to provide a controlled atmosphere and avoid leakage of atmospheric air containing oxygen from the atmosphere into the head space 44 of the outer bag 40.

Figure 5:
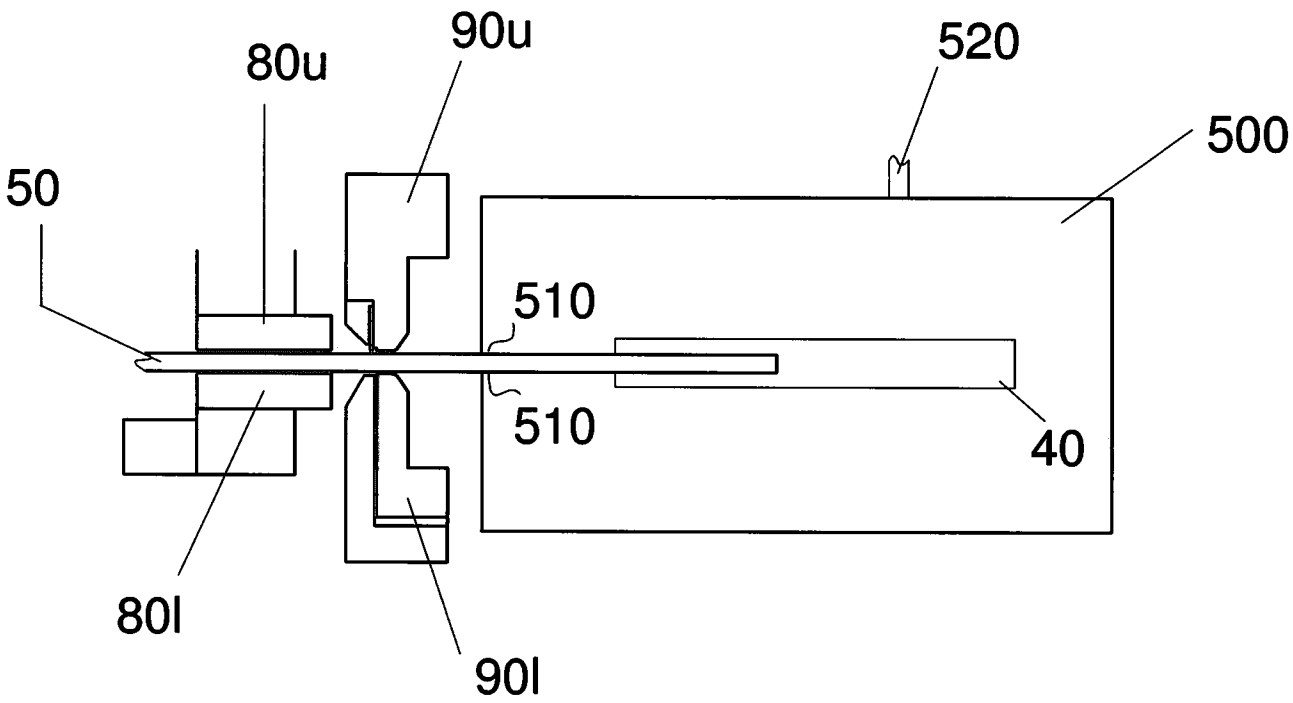
FIG. 5 shows a box about the outer bag.

In a further aspect, the amount of the inert gas in the head space 44 can be controlled by enclosing the double bag 20 with the outer bag 40 and the inner bag 30 with a chamber 500 as shown in FIG. 5. The chamber 500 is connected to a gas supply 520 which supplies a gas, such as nitrogen or another inert gas or indeed air, and is moved toward the support 14 on which the double bag 20 is placed in the manufacturing apparatus 10. The chamber 500 has sealing lips 510, which are used to form a substantially gas tight connection and the gas is supplied to a pre-determined pressure within the chamber 500. The gas pressure in the chamber 500 balances the pressure of the nitrogen head space 44 and ensures that a substantially similar amount of nitrogen (or other inert gas) is in the head space 44. This can be important in meeting customer and regulatory requirements.

REFERENCE NUMERALS

10 Manufacturing apparatus
**12*u*** Upper support
**12*l*** Lower support
14 Support
20 Double bag
30 Inner bag
32 Port
35 Contents
40 Outer bag
42 Top end
44 Head Space
50 Gas feeding tube
52 Spreading arms
60 Gas supply
70 Vacuum pump
80 gas box
**80*u*** Upper box
**80*l*** Lower box
**82*u*** Sealing rim
**82*l*** Sealing rum
84 Nitrogen space
86 Nitrogen feed line
**90*u*** Upper support
**90*l*** Lower support
500 Chamber
510 Sealing lips
520 Gas supply

What is claimed is:

1. Method for manufacturing a double bag having an inner bag in an outer bag with an open top end, the method comprising:
- inserting a gas feeding tube through the open top end;
- placing a gas box over the open top end;
- feeding a head space between the inner bag and the outer bag with an inert gas through the gas feeding tube;
- enclosing the double bag with a chamber and thereby controlling the amount of the inert gas in the head space;
- extracting the gas feeding tube; and
- sealing the outer bag.

2. The method of claim 1, wherein placing the gas box comprises closing an upper box and a lower box.

3. The method of claim 1, wherein the inert gas is nitrogen.

4. The method of claim 1, wherein the gas box is flushed with nitrogen prior to feeding the head space.

5. The method of claim 1, further comprising evacuating substantially all the air from the head space prior to feeding the head space with the inert gas.

6. The method of claim 1, wherein the feeding of the head space with the inert gas comprises feeding the head space with the inert gas a first time, followed by evacuation of the head space and subsequently feeding the head space with an inert gas a second time.

7. The method of claim 1, further comprises at least partially sealing the top end prior to feeding the head space with the inert gas.

8. The method of claim 1, wherein inner bag comprises at least one of a liquid or a powder.

9. The method of claim 1, further comprising asserting a defined pressure about a lower part of the outer bag.

10. An apparatus for the manufacture of a double bag comprising:
- a placement device for placing an inner bag in an outer bag in a bag sealing machine;
- a gas box for enclosing an open top end of the outer bag;
- a welding device for sealing top edges of the outer bag;
- a gas feeding device for filing a head space between the inner bag and the outer bag with an inert gas; and
- a chamber for enclosing the double bag.

11. The apparatus of claim 10, wherein the gas box comprises an upper box and a lower box.

12. The apparatus of claim 10, wherein the gas feeding device comprises a removable tube adapted to be removed after filling the head space with the inert gas.

13. The apparatus of claim 10, further comprising a vacuum device for evacuating the head space.

14. The apparatus of claim 10, further comprising a chamber for enclosing a bottom of the outer bag.

15. The apparatus of claim 14, wherein the chamber maintains a constant pressure about the outer bag.

* * * * *